United States Patent [19]

Eisenpresser

[11] 4,000,547

[45] Jan. 4, 1977

[54] SNAP FASTENER

[76] Inventor: Marvin L. Eisenpresser, 4 Willow Lane, Hewlett Harbor, N.Y. 11557

[22] Filed: July 25, 1975

[21] Appl. No.: 598,741

[52] U.S. Cl. ..... 24/214

[51] Int. Cl.[2] ..... A44B 17/00

[58] Field of Search ..... 24/213 R, 214, 220, 24/208 A

[56] References Cited

UNITED STATES PATENTS

| | | | |
|---|---|---|---|
| 192,267 | 6/1877 | Kuder | 24/213 R |
| 672,496 | 4/1901 | Smith | 24/220 |
| 1,360,914 | 11/1920 | Forslund | 24/220 |
| 1,426,100 | 8/1922 | Pullen | 24/220 |
| 1,937,704 | 12/1933 | Kluger | 24/213 R |
| 2,895,199 | 7/1959 | Jones | 24/213 R |
| 3,613,181 | 10/1971 | Taylor | 24/213 R X |
| 7,323,786 | 6/1903 | Schopbach | 24/214 X |

FOREIGN PATENTS OR APPLICATIONS

| | | | |
|---|---|---|---|
| 95,536 | 1/1898 | Germany | 24/214 |

*Primary Examiner*—Donald A. Griffin

*Attorney, Agent, or Firm*—Roylance, Abrams, Berdo & Kaul

[57] ABSTRACT

A two-part snap fastener comprising a socket assembly and a stud assembly adapted for releasable engagement with one another. The socket assembly includes a decorative cap, a spacer member, an eyelet, and a rigid washer, with the eyelet being coupled to the cap and attaching the assembly to a support by locking the support between the cap and washer. The stud assembly includes a base, a resiliently deformable washer and an eyelet coupling the washer to the base. The base is in turn coupled to a second support. The deformable washer of the stud assembly is releasably engageable with the rigid eyelet of the socket assembly, the latter having a portion with an inside diameter smaller than the outside diameter of the former.

9 Claims, 9 Drawing Figures

SNAP FASTENER

The present invention relates to a two-part snap fastener which parts are adapted for releasable engagement with one another, and more particularly relates to a snap fastener having a socket assembly with a rigid inner ring for receiving a resiliently deformable washer located on a stud assembly.

Numerous snap fasteners have been disclosed in the prior art usually in conjunction with various garments, such as coats, shirts, belts and handbags. In any event, snap fasteners are ordinarily used to releasably connect two portions of a garment, or in a broader sense, two support structures.

While many such snap fasteners are known, numerous disadvantages have plagued the art. First, snap fasteners that perform the function of providing an easily openable but secure fastening device are quite expensive to manufacture. Additionally, many of these prior art snap fasteners are difficult to manufacture and involve complicated, time-consuming steps. Moreover, many of the prior art snap fasteners are easily breakable, and therefore are not durable, with the garment many times outliving the fasteners used thereon. Furthermore, many snap fasteners are either too difficult to engage and disengage because the tension between the two parts is too high, or on the other hand the tension is not high enough and the two parts of the snap fastener do not result in secure fastening. Finally, many snap fasteners are not securely fastened to the garment, or support, upon which they are used, resulting in an unwanted removal from the garment of various parts of the fastening device or a tearing of the garment itself.

It is therefore an object of the present invention to overcome the limitations and drawbacks associated with the aforesaid prior art snap devices and to provide a new and improved snap fastener for joining two supports, or parts of a garment.

Another object of the present invention is to provide a cheap and easily manufactured snap fastener which is also decorative.

Another object of the present invention is to provide a durable snap fastener which is also easily secured to a garment so as not to become removed therefrom or a cause of ripping of the garment.

Another object of the present invention is to provide a snap fastener which provides a secure coupling which is not too difficult to disengage.

The foregoing objects are attained by providing a snap fastener comprising a socket portion and a stud portion adapted for releasable engagement with one another, the stud portion including a continuous circular resiliently deformable member, means for axially retaining the deformable member and for exposing and permitting deformation of only the peripheral margin thereof, and means for attaching the stud portion to a first support, the socket portion including means for defining an annular radially inwardly extending substantially rigid wall having a minimum diameter smaller than the undeformed outer diameter of the deformable member, and means for attaching the socket portion to a second support.

In particular, the snap fastener stud portion comprises a generally circular base member having a central opening; a continuous annular resilient washer having a central opening substantially aligned with the central opening of the base member and having an outward diameter larger than the outer diameter of the base member, one face of the resilient washer being adjacent the base member; an eyelet having a substantially flat annular portion adjacent the other face of the resilient washer, and a tubular portion extending through the central opening in the resilient washer and the base member, the tubular portion having an enlarged portion at the distal edge thereof for engaging the base member, the annular portion having an outer diameter smaller than the outer diameter of the resilient washer; and means for connecting the stud to a support.

In addition, the snap fastener socket comprises a cup-shaped cover having a main portion and a peripheral wall extending therefrom; a spacer member in the cover; an eyelet having a radially outwardly extending flange portion in the cover adjacent the spacer member and a circularly continuous tubular portion extending axially out of the cover, the distal edge of the cover peripheral wall being bent inwardly to engage and retain the flange portion of the eyelet; and washer means surrounding the tubular portion for engaging the edges of the opening in the support and for clamping the edges between the peripheral wall and the flange portion, the distal edge of the tubular portion being uniformly outwardly deformed around the washer means to engage and retain the washer means in clamping relationship against the support, whereby the inner surface of the tubular portion provides an inwardly extending substantially rigid ring-like surface for releasable engagement with a resilient stud.

Other objects, advantages and salient features of the present invention will become apparent from the following detailed description which, taken in conjunction with the annexed drawings, discloses a preferred embodiment of the present invention.

Referring now to the drawings which form a part of this original disclosure:

Figure 8:
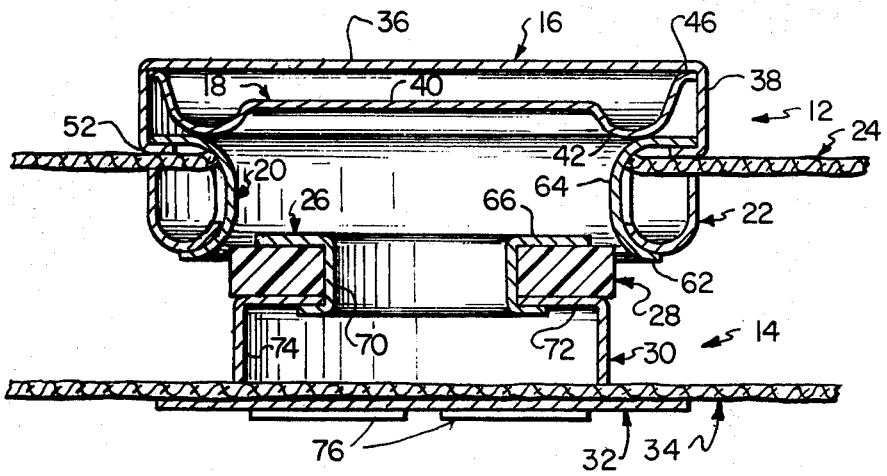
Figure 9:
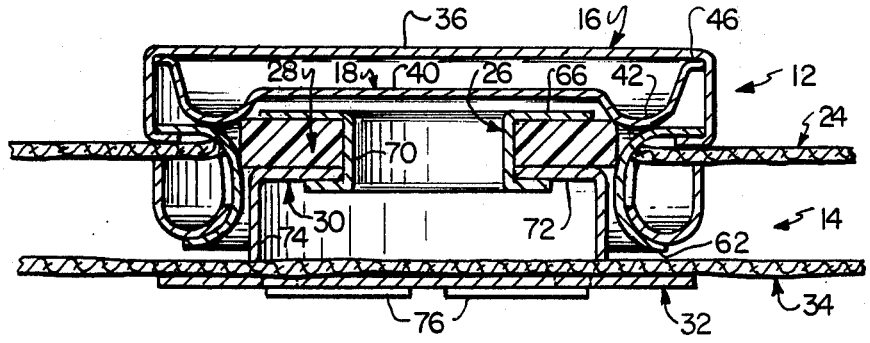

FIG. 8 is a vertical longitudinal sectional view in elevation of the socket assembly and stud assembly of the present invention just prior to their being engaged with one another; and FIG. 9 is a view similar to that shown in FIG. 8, but showing the stud and socket assemblies fully engaged with the resilient washer on the stud assembly deformed against the inner ring-like portion of the socket assembly.

Figure 1:
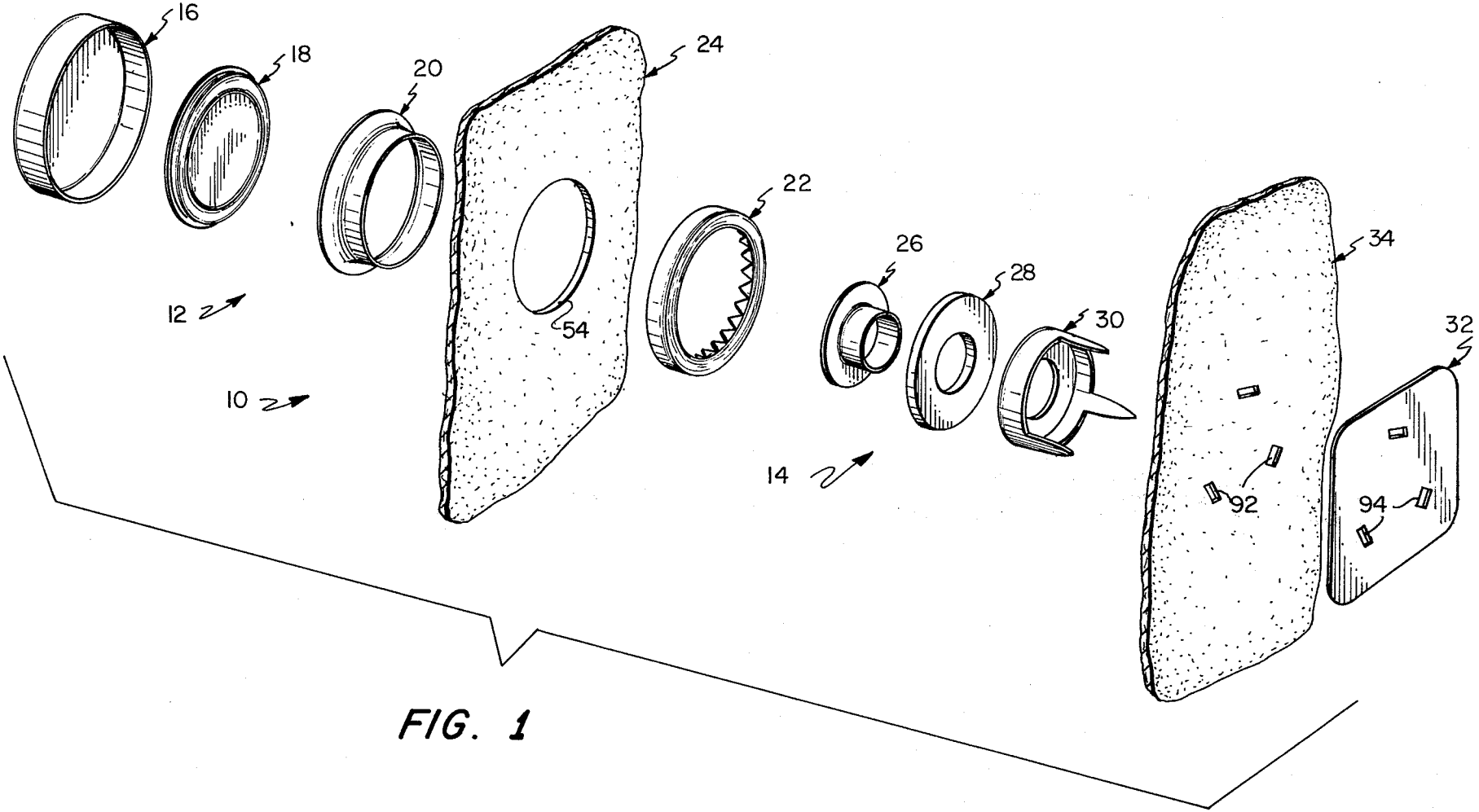
FIG. 1 is an exploded perspective of the two-part snap fastener in accordance with the present invention.

Referring to the drawings in further detail, the snap fastener of the present invention is generally designated 10, and as shown in FIG. 1, comprises a socket assembly 12 and a stud assembly 14.

The socket assembly includes a decorative cap 16, a spacer member 18, a socket eyelet 20, and a clamping washer 22, with a first support 24 being associated therewith.

The stud assembly 14 comprises a stud eyelet 26, a deformable washer 28, a base 30 and a backing member 32, with a second support 34 being associated therewith.

Figure 2:
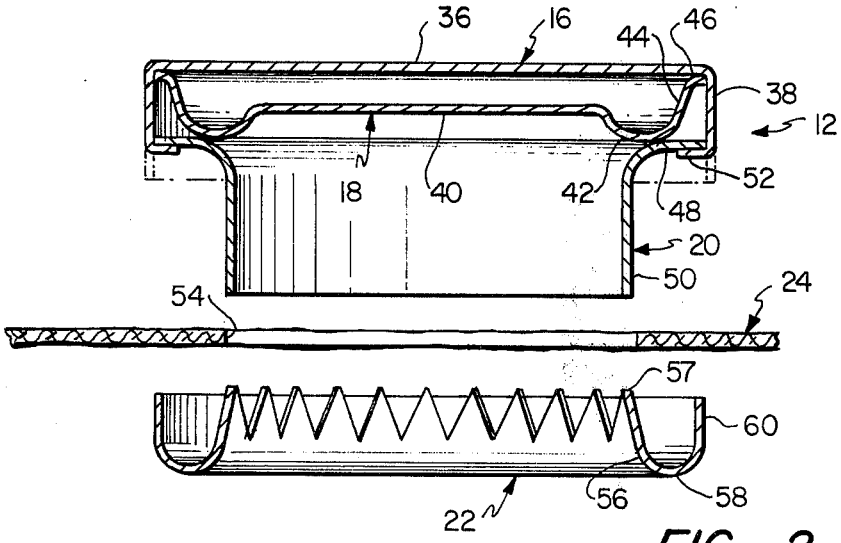
FIG. 2 is a vertical longitudinal sectional view, partly exploded, of the socket assembly of the present invention in elevation.

Referring now to FIG. 2, the socket assembly 12 has the decorative cap 16 formed preferably as a cup-shaped cover with a main portion 36 in the form of a planar wall with a peripheral wall 38 extending from the edge thereof. The top or exposed portion of the decorative cap may have various designs or aesthetically pleasing items, such as fabric, added thereto, this being the exposed part of the snap fastener. Preferably, the cap is stamped and drawn from sheet metal, and can have any desired outer shape or appearance.

The spacer member 18 is also preferably stamped from sheet metal and has a central substantially flat portion 40, an annular ridge 42, and a peripheral skirt 44 extending from the annular ridge terminating in an annular, outwardly extending flange 46 which is received in the corner formed by main portion 36 and peripheral wall 38 of the decorative cap 16. Thus, the outer diameter of the flange 46 is substantially equal to the inner diameter of the peripheral wall 38 of cap 16. The axial length of the spacer member 18 from the flange 46 to the farthest extension of the annular ridge 42 is somewhat less than the axial length of the peripheral wall 38 of the cap 16.

The socket eyelet 20, as shown in FIG. 2 in its undeformed state, is formed with an annular flange portion 48 and a circularly continuous tubular portion 50 extending downwardly therefrom with the top of the annular flange portion 48 abutting the annular ridge 42 of spacer member 18 and the outer edge of the annular flange portion contacting the inner surface of peripheral wall 38 of the decorative cap 16.

As shown in FIG. 2, the distal edge 52 of the peripheral wall 38 is inwardly deformed, such as by a stamping process, to rigidly clamp the socket eyelet 20 in its position shown in FIG. 2 adjacent the cap 16 and the spacer member 18.

The initial position, from which the peripheral wall 38 is deformed, is shown in phantom lines in FIG. 2.

The first support 24, which can be a fabric, has a circular orifice 54 provided therein which is substantially equal to the outside diameter of the tubular portion 50 of socket eyelet 20, for the reception of such tubular portion.

As shown in FIG. 2, located below the first support 24 is the clamping washer 22 which is in the form of an annular circularly continuous member have a substantially U-shaped cross-section. This clamping washer 22 is integrally formed with an inner wall 56, a curved midportion 58 and an outer wall 60. The inner diameter of washer 22 is slightly larger than the outer diameter of the tubular portion 50 and the outer diameter is less than the outer diameter of peripheral wall 38. The inner wall 56 is higher than outer wall 60 and has serrations 57 thereon for engaging the support 24 and pressing it against the bottom side of flange portion 48.

After the socket assembly 12 shown in FIG. 2 is fabricated so that the spacer member 18 and socket eyelet 20 are coupled via the deformed distal edge 52 of peripheral wall 38, and the first support 24 is maneuvered around tubular portion 50 so that the top of the support is adjacent such distal edge 52, the clamping washer 22 is maneuvered upwards, as viewed in FIG. 2, so that the inner wall 56 thereof slides along the outside of tubular portion 50. This is continued until the top of the outer wall 60 clamps the first support 24 against the distal end 52 and serrations 57 press the first support 24 against annular flange portion 48.

Figure 3:
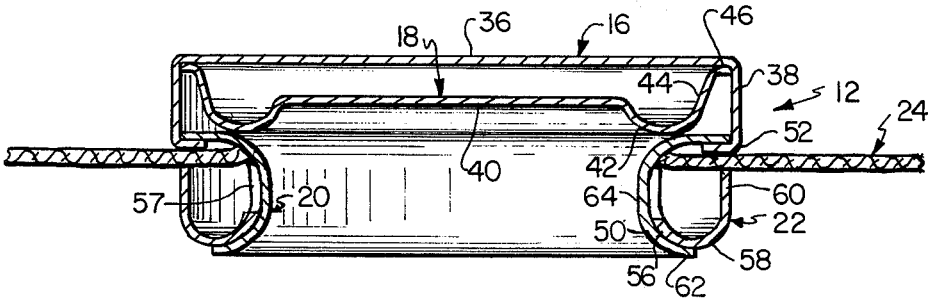
FIG. 3 is a view similar to FIG. 2, but showing the socket assembly fully assembled.

At this time, the bottom edge 62, as shown in FIG. 3, of tubular portion 50 of the socket eyelet 20 is outwardly deformed, such as by metal stamping, over the midportion 58 of the clamping washer 22 so that the washer is rigidly secured against the first support 24 which is in turn rigidly secured against distal edge 52 on the decorative cap and flange portion 48. Such a deformation of the tubular portion 50 results in a curved inner portion 64 having a convex configuration and forming a continuous, ring-like surface or wall having a minimum inner diameter smaller than the undeformed outer diameter of the deformable washer 28 associated with the stud assembly, as hereinafter more fully described.

Figure 4:
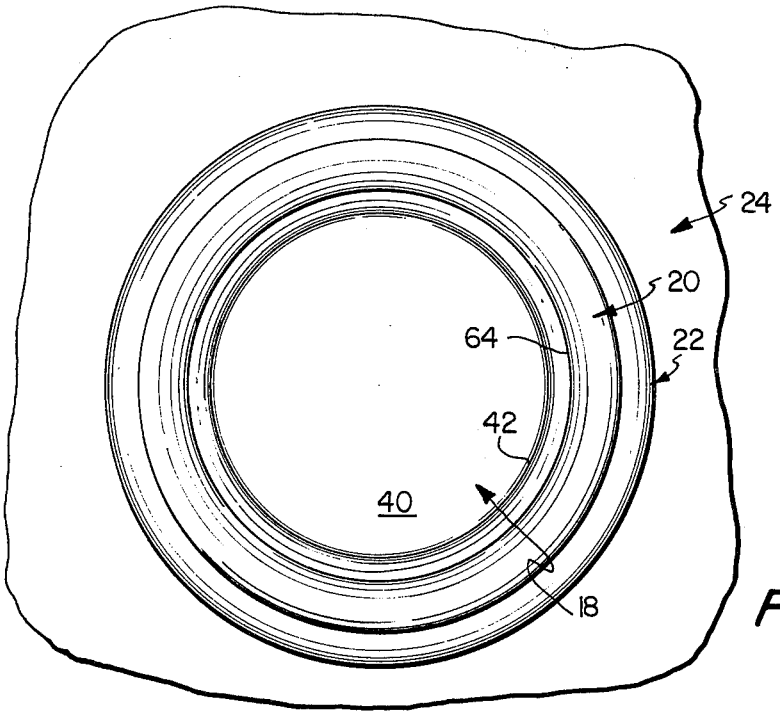
FIG. 4 is a bottom plan view of the fully assembled socket assembly shown in FIG. 3.
Figure 7:
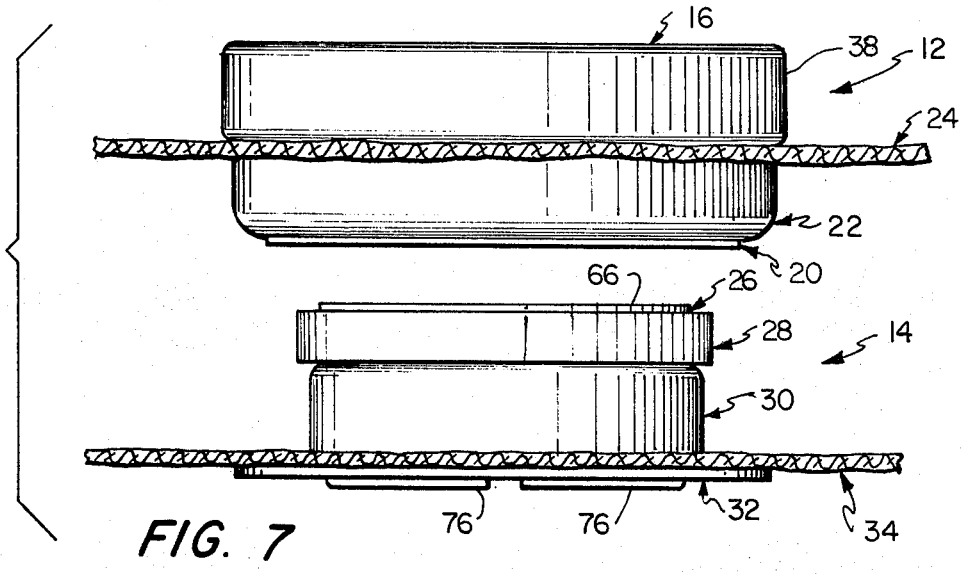
FIG. 7 is an elevational view showing the socket and stud assemblies of the present invention, fully assembled and about to be engaged.

The fully assembled socket assembly 12 is also shown in FIGS. 4 and 7 hereof.

Figure 5:
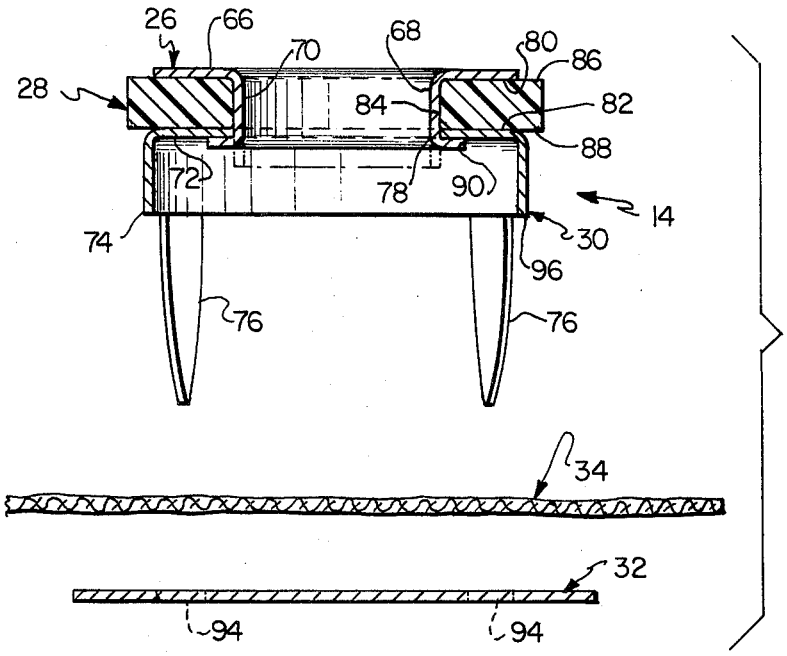
FIG. 5 is a vertical longitudinal sectional view, partly exploded, of the stud assembly of the present invention, in elevation.
Figure 6:
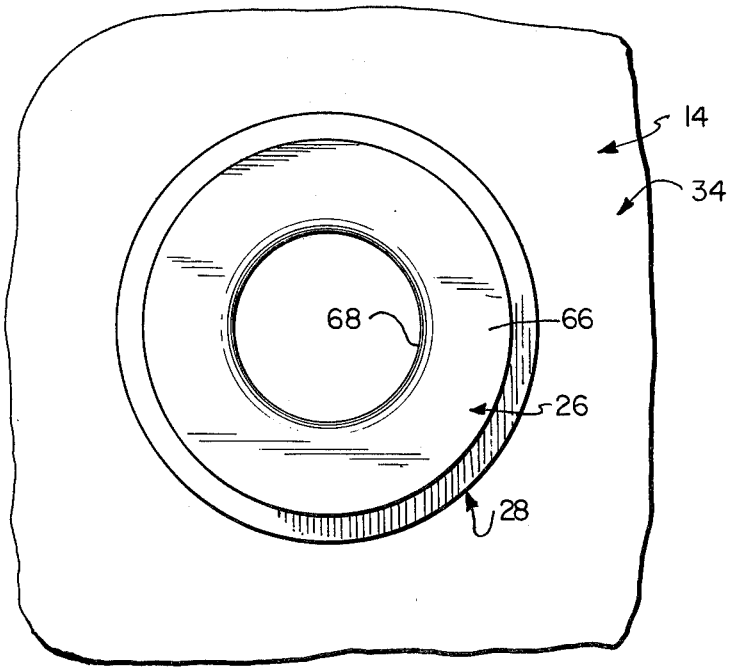
FIG. 6 is a top plan view of the stud assembly shown in FIG. 5.

Referring now to FIGS. 5 and 6, the stud assembly 14 includes the stud eyelet 26 formed as a sheet metal member including a flat washer or annular portion 66 with a central opening 68 therein from which axially depends a tubular portion 70.

The base 30 of the stud assembly 14 is comprised of a stamped sheet metal cap including a flat main wall 72 and a circular depending side wall 74. Integrally formed and extending downwardly from the side wall substantially evenly spaced along the periphery of the side wall 74 are a plurality of prongs 76, pointed at the ends. The flat main wall 72 has a central opening 78 therein which is substantially equal to the outer diameter of tubular portion 70 of stud eyelet 26.

Interposed between the bottom face 80 of the flat washer 66 and the top face 82 of base 30 is the continuous annular resiliently deformable washer 28, which is preferably formed of polyethylene.

Deformable washer 28 has a central opening 84 which is substantially equal to the outer diameter of tubular portion 70 of the stud eyelet 26. Additionally, the outer edge of the deformable washer 28 is straight to define a cylindrical outer surface. Thus, this deformable washer 28 has a top major surface 86 adjacent the bottom face 80 of the stud eyelet 26 and a bottom major surface 88 adjacent the top face 82 of the base 30.

The outer diameter of the deformable washer 28 is greater than the outer diameter of flat washer 66 and is greater than the outer diameter of base 30.

The deformable washer 28 is axially retained on the base 30 by means of the stud eyelet 26 wherein the distal edge 90 of the stud eyelet's tubular portion 70 is outwardly deformed, such as by stamping, so that it abuts the bottom of flat main wall 72 of the base. The position from which the distal edge 90 is moved is shown in phantom lines in FIG. 5.

As shown in FIG. 5, the second support 34 is positioned below the prongs 76 and either has preformed apertures 92, as shown in FIG. 1, therein corresponding to prongs 76, or else prongs 76 are forced through the support 34, thereby forming apertures therein. In any event, the prongs 76 pass through the second support 34 and secure the base 30 to the support by means of a backing plate 32 having apertures 94 therein for reception of the prongs. Once the prongs penetrate these apertures, the prongs are bent through 90°, thereby securing the base, the support 34 and the backing member 32 together. Alternatively, rivets could be used instead of the prongs.

The fully assembled stud assembly 14 secured to the second support 34 is shown in FIGS. 7, 8 and 9, wherein the bottom edge 96 of side wall 74 in the base 30 abuts the top of the second support 34 and the bent prongs 76 clamp the base to the support 34.

Turning now to FIG. 7, the fully assembled socket assembly 12 and the fully assembled stud assembly 14 are shown in a position in which they are about to be engaged with one another. This position is obtained by axially aligning these two parts.

As shown in FIG. 8, as these assemblies are moved closer together, it is clear that the outer diameter of the deformable washer 28 is larger than the inner diameter of the deformed socket eyelet 20 insofar as the inner portion 64 is of a smaller diameter than the outer diameter of the undeformed deformable washer 28.

As the two assemblies are axially pushed toward one another, the deformable washer 28 is deformed as it runs along the inner surface of the socket eyelet 20 until if reaches the smallest diameter thereof at which time the outer margin of the deformable washer 28 outwardly expands, as shown in FIG. 9. In this position, preferably, the top of the flat washer 66 on the stud eyelet 26 lies substantially adjacent the flat portion 40 of the spacer member 18 in the socket assembly 12. Since the deformable washer 28 is rigidly secured between the flat washer 66 on its top, the flat main wall 72 of the base 30 on its bottom and the tubular portion 70 of stud eyelet 26 at its central opening, only the peripheral margin of the deformable washer 28 is exposed and permitted to be deformed. Such an exposure and deformation assures a secure fit between the stud assembly 14 and its associated socket assembly 12. After deformable washer 28 is forced past the smallest inner diameter of the socket at portion 64, the deformable washer is permitted to expand, at least partly returning to its original size. Thus, the stud assembly 14 and socket assembly 12 remain engaged until adequate pressure is exerted to pry them apart.

In order to separate the two assemblies, and open the snap fastener, the two supports 24 and 34 are pulled apart causing a portion of the outer margin of the deformable washer 28 to be deformed inwardly sufficiently for the washer 28 to pass by the inner portion 64 of the socket eyelet tubular portion 50.

Additionally, since the first support 24 is securely clamped to the socket assembly 12 and the second support 34 is securely fastened to the stud assembly 14, the likelihood of these supports becoming disengaged from their respective parts is quite small.

Thus, a decorative, cheap, easily manufactured, long-lasting and effective snap fastener is formed by the combination of the socket assembly 12 and stud assembly 14 described above, and this combination can be in a variety of sizes, as desired.

While one advantageous embodiment has been chosen to illustrate the invention, it will be understood by those skilled in the art that various changes and modifications can be made therein without departing from the scope of the invention as defined in the appended claims.

What is claimed is:

1. A snap fastener stud attachable to a support comprising the combination of:

a generally circular base member having a central opening;

a continuous annular resilient washer having a central opening substantially aligned with said central opening of said base member and having an outer diameter larger than the outer diameter of said base member, one face of said resilient washer being adjacent said base member;

an eyelet having a substantially flat annular portion adjacent the other face of said resilient washer, and a tubular portion extending through said central openings in said resilient washer and said base member, said tubular portion having an enlarged portion at the distal edge thereof for engaging said base member, said annular portion having an outer diameter smaller than the outer diameter of said resilient washer; and means for connecting said stud to a support.

2. A snap fastener socket attachable through an opening in a support comprising:

a cup-shaped cover having a main portion and a peripheral wall extending therefrom;

a spacer member in said cover;

an eyelet having a radially outwardly extending flange portion in said cover adjacent said spacer member and a circularly continuous tubular portion extending axially out of said cover, the distal edge of said cover peripheral wall being bent inwardly to engage and retain said flange portion of said eyelet;

and washer means, surrounding said tubular portion, for engaging the edges of the opening in the support and for clamping said edges between said peripheral wall and said flange portion, the distal edge of said tubular portion being uniformly outwardly deformed around said washer means to engage and retain said washer means in clamping relationship against said support, whereby the inner surface of said tubular portion provides an inwardly extending substantially rigid ring-like surface for releasable engagement with a resilient stud.

3. A snap fastener socket according to claim 2 wherein said spacer member comprises a flat portion, an annular ridge surrounding said flat portion, a peripheral skirt extending from said annular ridge and a circular flange extending from said peripheral skirt into contact with said cover peripheral wall.

4. A snap fastener socket according to claim 2 wherein said eyelet flange portion has an outer diameter substantially equal to the inner diameter of said cover peripheral wall.

5. A snap fastener socket according to claim 2 wherein said washer means has an outer diameter smaller than the outer diameter of said cover peripheral wall.

6. A snap fastener stud assembly comprising:

a continuous annular resiliently deformable washer having substantially flat opposite major faces and a central opening;

a base member having an outer diameter smaller than the outer diameter of said deformable washer and a substantially flat face adjacent one major face of said deformable washer;

a substantially flat washer means adjacent the other major face of said deformable washer, said flat washer means having an outer diameter smaller than the outer diameter of said deformable washer;

means connected to said base member and to said flat washer means and extending through said central opening in said deformable washer for clamping said deformable washer between said base member and said flat washer means; and means for connecting the stud assembly to a support.

7. A snap fastener stud assembly according to claim 6 wherein said deformable washer has a cylindrical outer surface.

8. A snap fastener stud assembly according to claim 6 wherein said means for clamping comprises a tubular portion extending downwardly from said flat washer means.

9. A snap fastener comprising a socket portion and a stud portion adapted for releasable engagement with one another, said stud portion including a continuous circular resiliently deformable member;

means for axially retaining said deformable member and for exposing and permitting deformation of only the peripheral margin thereof; and means for attaching said stud portion to a first support;

said socket including means for defining an annular, radially inwardly extending, substantially rigid wall having a minimum diameter smaller than the undeformed outer diameter of said deformable member; and means for attaching said socket portion to a second support;

said deformable member having a central opening, said means for axially retaining said deformable member and for exposing and permitting deformation of only the peripheral margin thereof including a generally circular base member having a central opening aligned with said deformable member central opening, and an eyelet having a substantially flat annular portion and a tubular portion passing through the central openings of said base member and said deformable member, the distal edge of said tubular portion being bent outwards to engage said base member.

* * * * *